US006363756B1

(12) United States Patent
Seagar et al.

(10) Patent No.: US 6,363,756 B1
(45) Date of Patent: Apr. 2, 2002

(54) TOP LOADING LAUNDRY APPLIANCE

(75) Inventors: Neville David Seagar; Gordon Sharpe Hunter; Joanne Mercia Oliver; Cameron Bruce William Treeby; Russell Joseph Jackson, all of Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 09/435,055

(22) Filed: Nov. 8, 1999

(51) Int. Cl.[7] ..... D06F 37/26
(52) U.S. Cl. ..... 68/210
(58) Field of Search ..... 68/210; 34/603; 312/228, 270.2, 270.3

(56) References Cited

U.S. PATENT DOCUMENTS 2,667,400 A * 1/1954 Wotring ..... 312/270.3
3,139,744 A * 7/1964 Van Alstyne et al. ..... 68/210 X
4,535,610 A 8/1985 Fey et al.

FOREIGN PATENT DOCUMENTS

WO 9312706 12/1992

* cited by examiner

*Primary Examiner*—Philip Coe
(74) *Attorney, Agent, or Firm*—Trexler, Busnell, Giangiorgi, Blackstone & Marr, Ltd.

(57) ABSTRACT

A laundry appliance such as a washing machine (2, 300) or a clothes drier (200) where user access to the clothes containing vessel (1, 201, 301) is facilitated by supporting the vessel in a structure (105, 205, 305) which may be tilted or slid out of the front of the appliance cabinet. When the structure is withdrawn from the cabinet the vessel hatch (35) is accessed substantially from the top. The vessel is preferably mounted with its axis horizontal and oriented in a side to side or "east-west" direction. The appliance motor (44/45, 210) control system sets the rotational position of the clothes vessel (1, 201, 301) so that when the structure (105, 205, 305) is withdrawn from the cabinet the hatchway is upper most. The hatch (35) is slid back to allow access to the vessel interior as part of the rotational positioning process.

9 Claims, 9 Drawing Sheets

TOP LOADING LAUNDRY APPLIANCE

FIELD OF THE INVENTION

This invention relates to laundry appliances and in particular laundry appliances where the container in which the laundry is placed is presented to the user by being movable out of the laundry appliance cabinet.

DESCRIPTION OF THE PRIOR ART

Many laundry washing machines are front loading. This means users must bend over to load and unload the machines. A similar situation exists for many clothes dryers of the tumble type.

It is known to provide dishwashers with a sliding drawer arrangement whereby the wash system is mounted within the cabinet in such a manner in which it may be withdrawn horizontally out of the cabinet to permit access to an open top to load and unload dishes. Half height dishwashers of this type may be mounted so that they may be loaded at kitchen bench height. An example of such a dishwasher can be found in WO 93/12706. Ergonomic factors indicate this broad concept of moving load carrying vessels out of cabinets may be also useful in other home appliances, particularly but not solely appliances for the washing or drying of laundry.

SUMMARY OF THE INVENTION

It is an object of the present invention to provide a laundry appliance whereby the laundry containing vessel may be moved out of the appliance cabinet for ease of loading and unloading.

In a first aspect the invention may broadly be said to consist in a laundry appliance comprising:

(a) a cabinet, (b) a laundry handling system moveably mounted within said cabinet in such a manner that it may be withdrawn out of said cabinet for access thereto, said laundry handling system including:

(i) a structure moveably coupled within the interior of said cabinet in such a way as to allow at least the upper part of the structure to be moved outwardly from said cabinet, (ii) a vessel for accommodating said laundry rotatably supported within said structure, (iii) means for rotating said vessel, (iv) means for introducing fluid into said vessel, (v) means for evacuating fluid from said vessel, and (c) a front panel which forms part of said structure and which when the laundry handling system is retracted closes said cabinet to provide a fluid tight envelope about said vessel.

In a further aspect the invention may broadly be said to consist in a laundry appliance comprising:

(a) a cabinet, (b) a laundry handling system mounted within said cabinet in such a manner that it may be forwardly tilted about a lower portion thereof to project out of said cabinet for access thereto, said laundry handling system including:

(i) a structure coupled at lower side portions within the interior of said cabinet in such a way as to allow the structure to revolve outwardly from said cabinet, (ii) a vessel which in use contains said laundry rotatably and transversely mounted within an upper portion of said structure, such that the axis of said vessel is orthogonal to the direction of travel of said structure;

(iii) means for rotating said vessel, (iv) means for introducing fluid into said vessel, (v) means for evacuating fluid from said vessel, (c) a front panel which forms part of said structure and which when the laundry handling system is retracted closes said cabinet to provide a fluid tight envelope about said vessel.

The term "fluid", as used above, means wash liquid in the case of washers and air in the case of driers.

In the preferred embodiments appliances of the present invention, whether washers or driers, are horizontal axis machines. However, horizontal axis washing machines up until now have not been well favoured with regard to ergonomics, cycle time, and clothes capacity. Similar ergonomic problems exist with conventional front loading dryers. To address the significant issue of ergonomics an 'east-west' mounting of the machine's axis is adopted together with a moving mechanism to present the clothes vessel to the user upon opening. Entry into the clothes vessel is provided through the wall of the vessel through a hatch that is slid circumferentially around the vessel before opening.

DESCRIPTION OF THE VARIOUS EMBODIMENTS OF THE INVENTION

Figure 1:
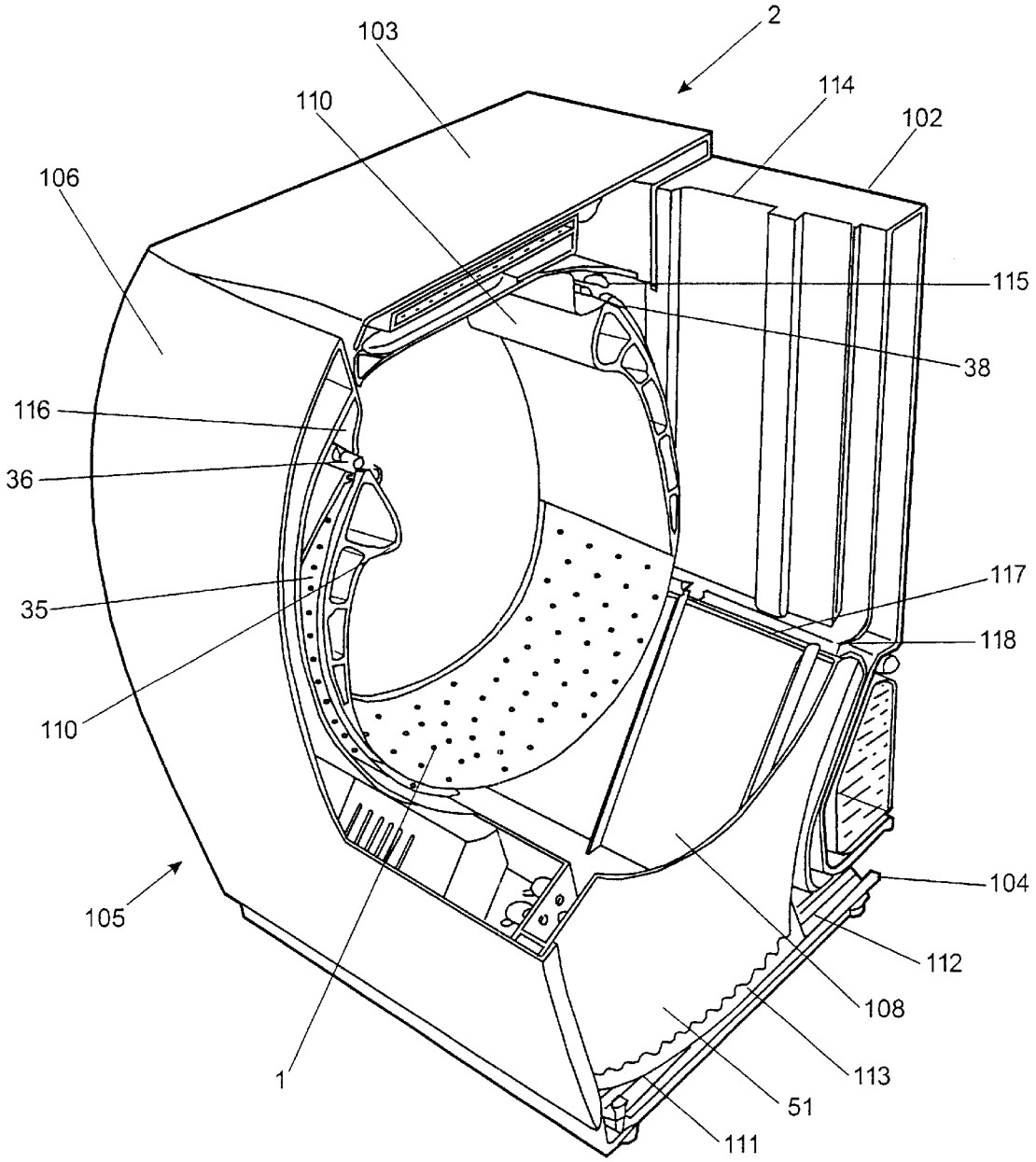
FIG. 1 is a cutaway perspective view of a first embodiment of a washing machine according to the present invention with the cutaway to show a substantial part of the machine in cross section.
Figure 2:
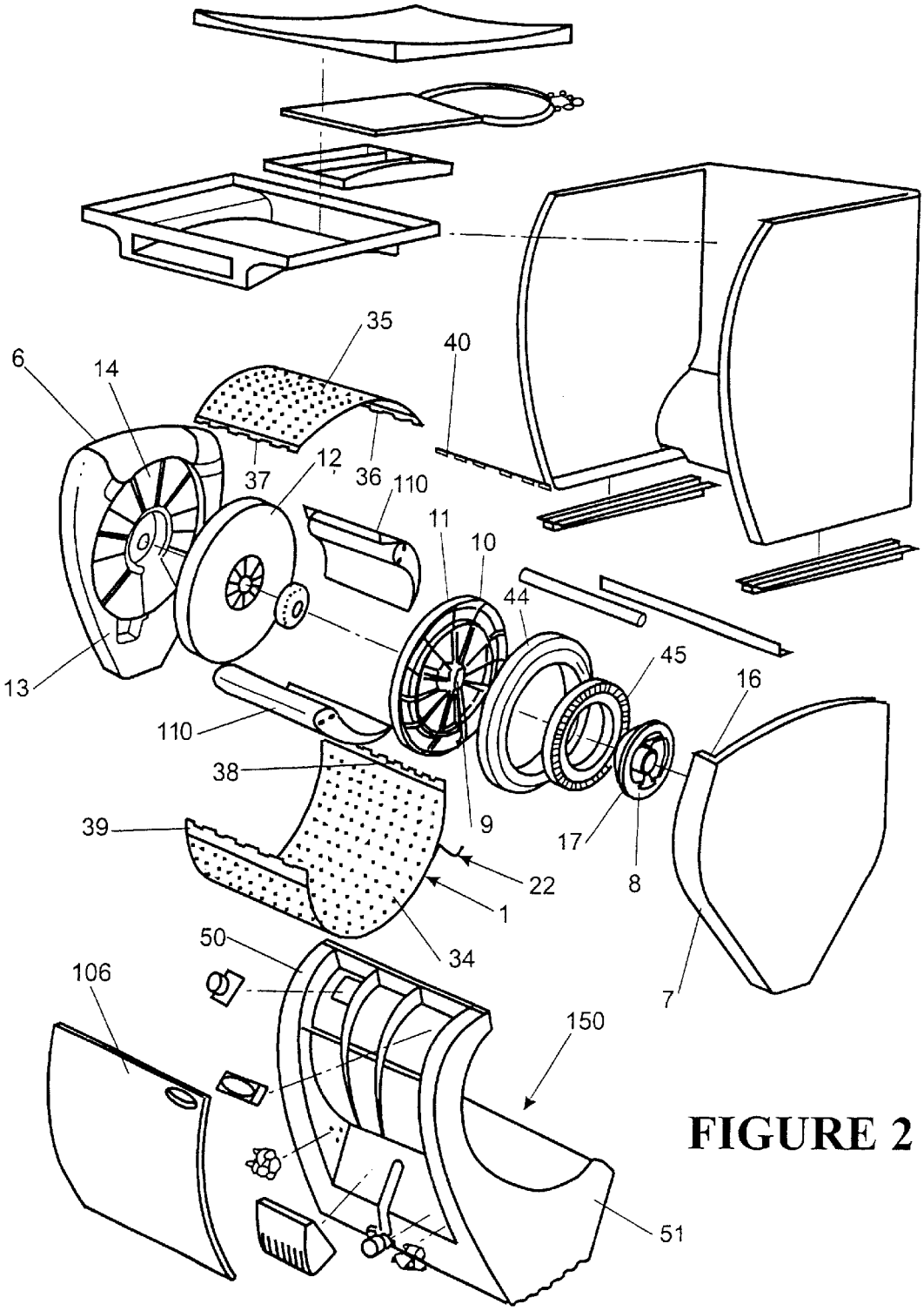
FIG. 2 is an exploded view of the washing machine of FIG. 1 showing the various major parts that go together to form the machine.
Figure 5:
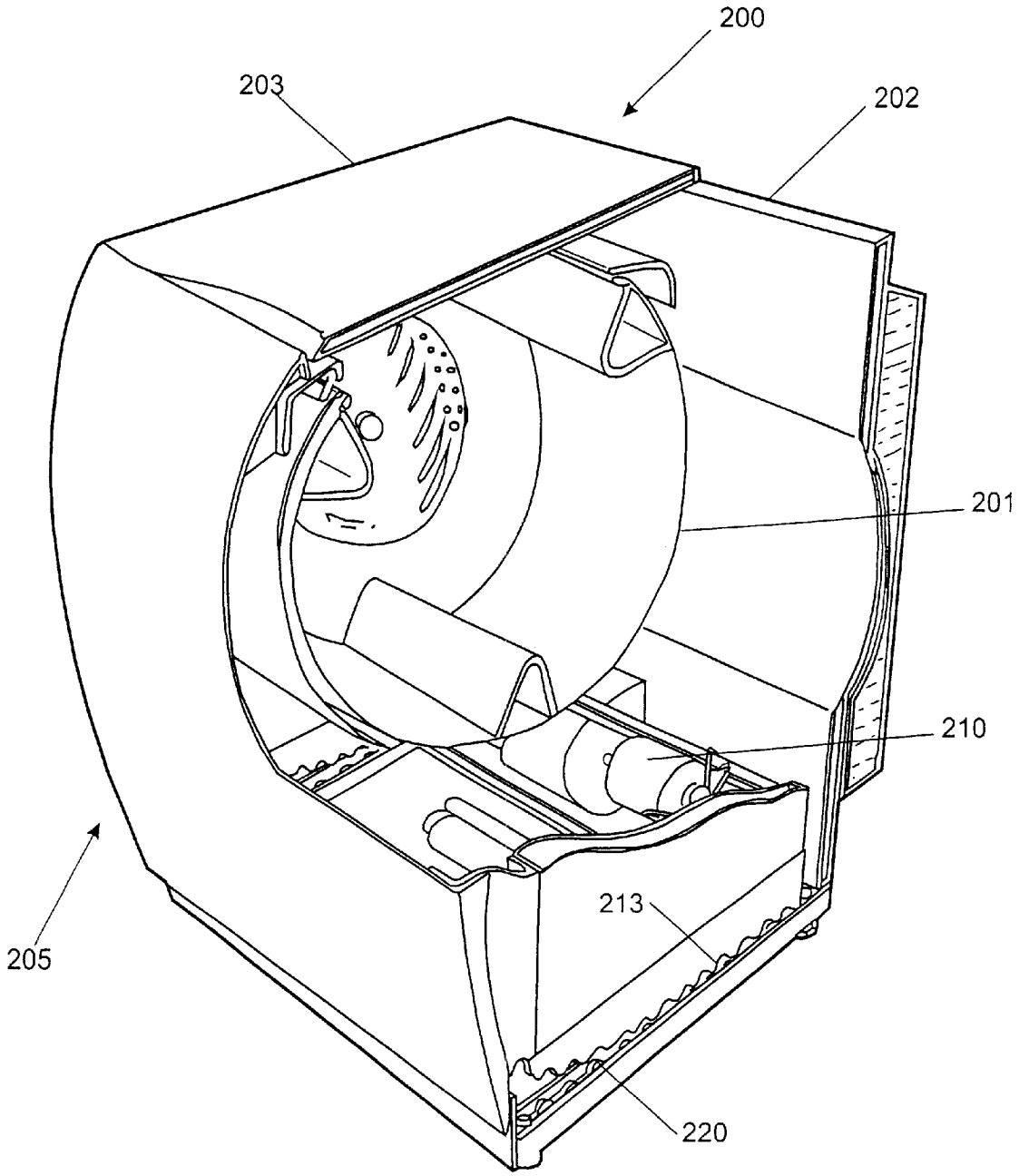
FIG. 5 is a pictorial view of a clothes drier according to the present invention and corresponds to the view of the washing machine shown in FIG. 1.

The present invention will be described primarily with reference to a laundry washing machine although many of the principles are equally applicable to laundry drying machines as is shown in FIG. 5. FIGS. 1 and 2 show a washing machine of the horizontal axis type, having a perforated drum 1 supported with its axis substantially horizontal in an "east-west" side-to-side orientation within a cabinet 2. The cabinet 2 includes surfaces which confine wash or rinse liquid leaving the drum within a water tight enclosure. Some parts of the cabinet structure 2 may be formed together with the liquid confining surfaces by for example twin-sheet thermoforming. In particular the back and side walls of the machine may be formed in this way.

Figure 3A:
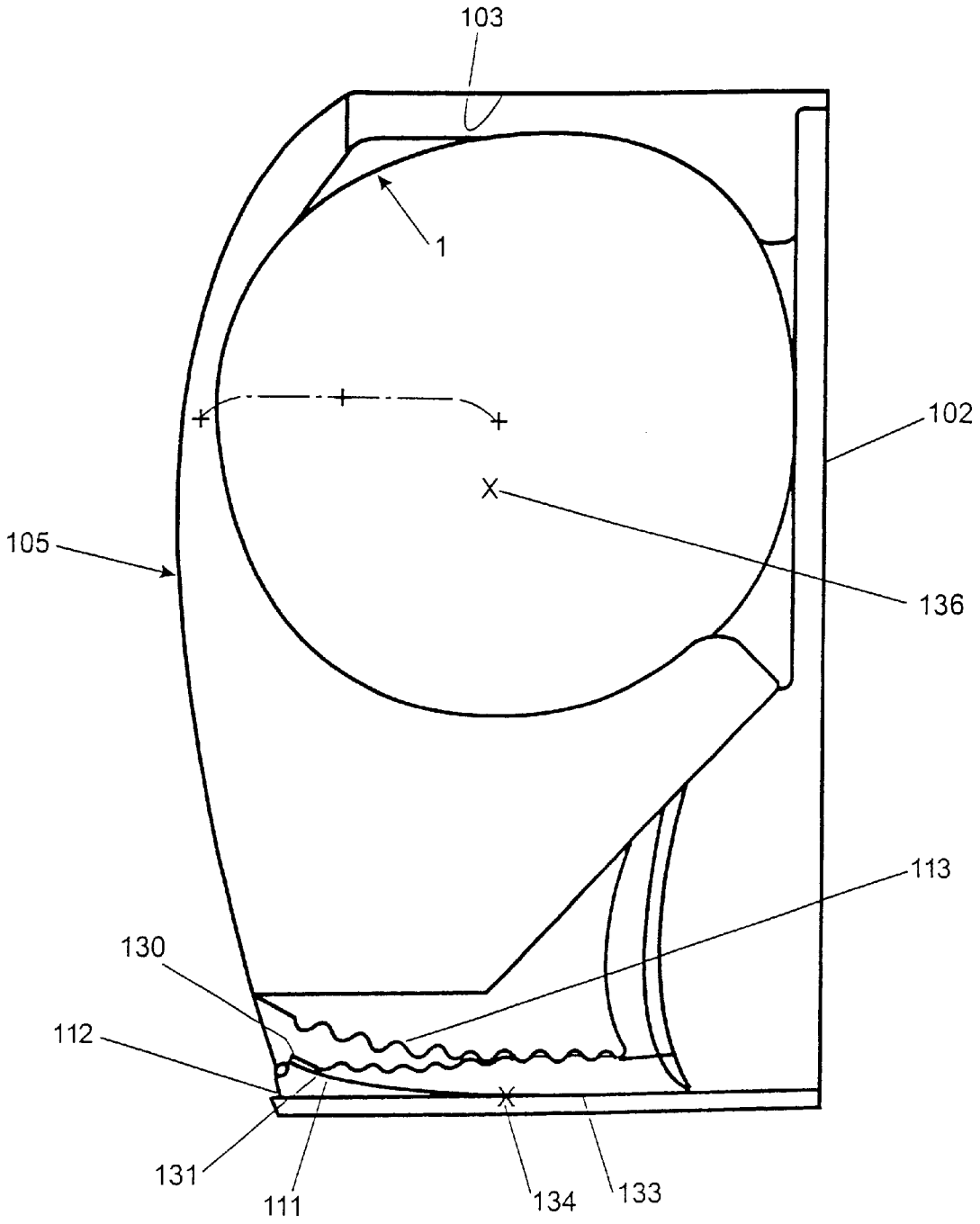
FIGS. 3*a* to 3*c* are diagrammatic cross sectional elevations demonstrating the manner in which the laundry handling system emerges from the cabinet.

The laundry handling system including the drum and many other components is in the preferred embodiment contained in a tiltable structure 150 to which a front panel 106 is attached to form a door to the cabinet 2. The laundry handling system is moveable out from cabinet 2 as explained later with reference to FIGS. 3*a*, 3*b* and 3*c*.

The drum 1 is rotatably supported by bearings 8 at each end which in turn are each supported by a drum support 6,7. In the embodiment depicted the bearings are axially located, externally, on a shaft means 9 protruding from the hub area 10 of the drum ends 11,12. Other axial configurations are equally possible, for example internally located in a well in the outer face of the hub area of the drum to be located on a shaft protruding from the drum support. The drum supports 6,7 are shown each as a base supported unit and have integrated form, which is suited to manufacture by twin sheet thermoforming, blow moulding or the like. Each drum support preferably includes a strengthening rib area 13,16 and a drum accommodating well area 14,15 as depicted to accommodate the respective drum end 11, 12 of the drum 1. The drum supports 6, 7 engage with sub-structure 150 by interlocking within complementary surfaces provided in the side walls 50, 51. Other less preferable constructions are possible, such as frameworks formed from individual members or mechanical suspension systems.

The drum supports each include a bearing support well at the centre of said well area 14,15. A flexible bearing mount 17 is located within the bearing support well, and in turn the bearing 8 fits within a boss in the bearing mount 17.

In the preferred embodiment of the present invention as depicted in FIGS. 1 and 2 the drum 1 comprises, in more detail, a perforated metal hoop 22, the pair of ends 11,12 enclosing the ends of the hoop 22 to form a substantially cylindrical chamber, and a pair of vanes 110 extending between the drum ends. In the preferred form of the invention the drum is driven only from one end 11 and consequently one purpose of the vanes 110 is to transmit rotational torque to the non-driven drum end 12. The vanes also provide longitudinal rigidity to the drum assembly 1. To these ends the vanes 110 are wide and shallow, although they have sufficient depth and internal reinforcing to achieve any required resistance to buckling due to unbalanced dynamic loads. Preferably the vanes have a distinct form, including a leading and trailing edge to assist in tumbling the washing load. In the preferred embodiment the vanes are oriented oppositely in a rotational direction, so that under rotation in either direction one vane is going forwards and the other backwards. This vane configuration provides further benefits in providing a user friendly opening into the washing chamber as is described below.

To give access to the inside of the drum 1 the perforated metal hoop 22 is divided circumferentially into two pieces, a main drum section 34 and a hoop completing hatch section 35. In FIG. 1 the hatch section is shown in its disconnected and withdrawn mode, with the machine prepared ready for opening. In the preferred form of the invention, the hatch section 35 extends the full width of the metal hoop 22, and is connected along opposed edges 36,37 thereof to the two free edges 38,39 of the main drum section. The hatch section is connected in such a way that it is fully secured to each edge of the main drum section against tensile forces. Therefore, under a spin cycle of the washing machine, with the drum rotating up to 1000 RPM or more, the drum is a fully connected and continuous hoop, which is optimal for handling the centrifugal forces thus generated. In the preferred form the hatch section 35 is connected along one edge 36 by an active mechanical latching mechanism which interconnects it with the respective free edge 38 of the main drum section 34. The latching mechanism may comprise a sliding bar 40 with a series of hook latches extending therefrom retained inside the looped over edge 36 of the hatch section 35. The series of hook latches is adapted to be engageable in a series of complimentary loops 41 extending from the corresponding edge 38 of the drum main section 34 upon lateral movement of the sliding bar 40. The other edge 37 of the hatch section 35 may be connected to its corresponding edge 39 of the drum main section 34 in a number of broadly different forms depending for example on the manner in which the hatch section is intended to open.

The washing machine includes an electric motor (rotor 44 and stator 45 visible in FIG. 2) to effect rotation of the drum during all phases of operation (wash, rinse and spin dry). In the preferred form of the washing machine incorporating the present invention the motor is a direct drive inside-out electronically commutated brushless dc motor having a permanent magnet rotor 44 coupled to one end 11 of the drum 1 and stator 45 coupled to the drum support 7. One suitable form of motor is described in EP0361775.

As previously stated, in the preferred embodiment of the washing machine incorporating the invention the drum 1 is supported between a pair of drum supports 6,7, one at either end thereof. Access to the interior of the drum 1 is provided through a slide away hatch section 35 in the cylindrical wall 22 of the drum. Accordingly the cabinet 2 of the washing machine is formed to provide access to the drum 1 in a substantially top loading fashion, rather than the traditional front loading fashion more common to horizontal axis machines.

It is a feature of the present invention to provide a laundry machine which provides for ease and convenience of loading and unloading laundry. This is achieved by mounting the "east-west" oriented drum 1 and associated components of the wash system in a moveable structure which in the preferred embodiment can be tilted out of the laundry machine cabinet to present the laundry drum 1 and in particular the hatch entry way into the drum at a convenient height for the user. A preferred form of configuration for achieving this is shown in FIG. 1, with the operation thereof demonstrated in FIGS. 3*a* to 3*c*. Laundry machine cabinet 100 formed by a rear wall 102, a top 103, a base 104, and side walls (not shown) is provided with an open front in which substructure 105 is mounted. Substructure 105 incorporates supports for rotating drum 109 along with the motor which drives the drum. A significant and integral part of this substructure is front wall 106 which closes off the cabinet 100 when the substructure is closed, that is, retracted into the cabinet.

Side walls 51 of the substructure 105 provide structural support and carry the load of drum 109 and the laundry load accommodated in the drum. They incorporate the drum supports 6,7 and their respective side wall members 50, 51. The lower most edges of side wall 51 transfer the substructure load to the cabinet base 104. Front panel 106 does not engage with base 104 and does not play part in weight transference.

The bottom edges 111 of side walls 51 are arcuate in shape to form "rocking" surfaces which "roll" within tracks 112 provided at each side of base 104. Thus in use substructure 105 may be tilted out of cabinet 100 in a rocking motion by applying an outward force to the top portion front panel 106. The "rocking" surfaces are preferably configured so that the rolling contact of arcuate surfaces 111 in tracks 112 ensures that for the major part of the tilt travel of the substructure, the anticipated centre of gravity of the substructure (including a possible or potential laundry load therein) is substantially vertically over the point of contact between surfaces 111 and tracks 112. This has some advantage over a pivoted substructure with a fixed pivot axis which requires either the user or additional componentary to bear some of the load when substructure 105 is tilted outwards.

To ensure that rocking surfaces 111 on each side of the substructure 105 track correctly and in lateral alignment along the base tracks 112 side walls 51 have rack teeth formed near the edges 111 and have a centre line which has the same curvature as rocking surfaces 111. These rack formations engage with a corresponding straight horizontal rack (shown in broken line 120 in FIG. 3) fixed to the side walls of cabinet 100 in the vicinity of base 104.

The "rocking" surfaces 111 may be substantially arcuate surfaces having the centre of gravity of the substructure 105 as their centre of curvature, such that in a steady state the centre of gravity should by its nature remain vertically above the contact between the surface 111 and the track 112. Deformations in the arcuate "rocking" surfaces 111 may be provided to produce "resistance" positions. For example a region 130 may be adjacent the forwardmost end of the "rocking" tracks where the contact surface of the rocker is non tangential with respect to the anticipated centre of gravity, the radius to points further forward reducing. In this way, as the substructure 105 rolls out of the cabinet 100, and the point of contact of "rocking" surface 111 moves past transition point 131 the anticipated centre of gravity 136 will move forward of the contact point and the substructure 105 will become biased into an open position, where further opening can be restrained for example by an engagement between sides of the substructure 105 and sides of the cabinet 100.

Similarly toward the back of the "rocking" surfaces 111 a flat region 133 may be provided. This flat region 133 may be horizontal, and engaging track 112 when the substructure 105 is in a closed position, and may extend forwards to a transition point 134 which lies just forward of the anticipated centre of gravity when the substructure 105 is in a closed position. The transition point 134 forms the effective contact point of the rocker surface in this configuration, and being forward of the centre of gravity this biases the substructure 105 to a closed position.

Figure 3B:
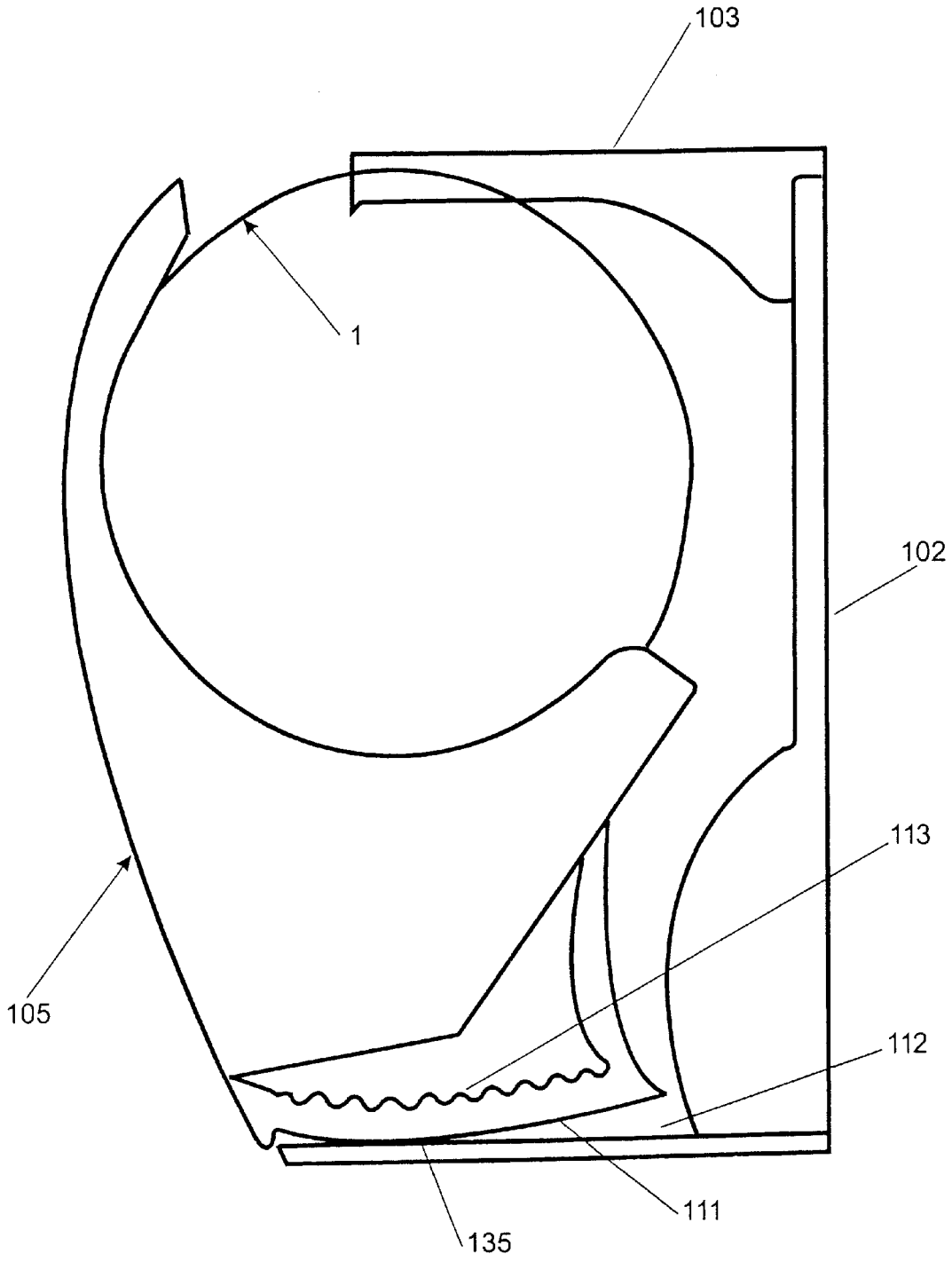

In addition, one or more further flat sections 135 may be provided on the rocking surfaces to provide intermediate "resistance" positions of the substructure 105, such as the position depicted in FIG. 3*b*, where the anticipated centre of gravity is vertically over a position along the flat surface with the flat surface flat against the track 112. The provision of such intermediate resistance positions allows the tiltable sub-structure to be opened in discrete steps which may find favour with many users.

Figure 4:
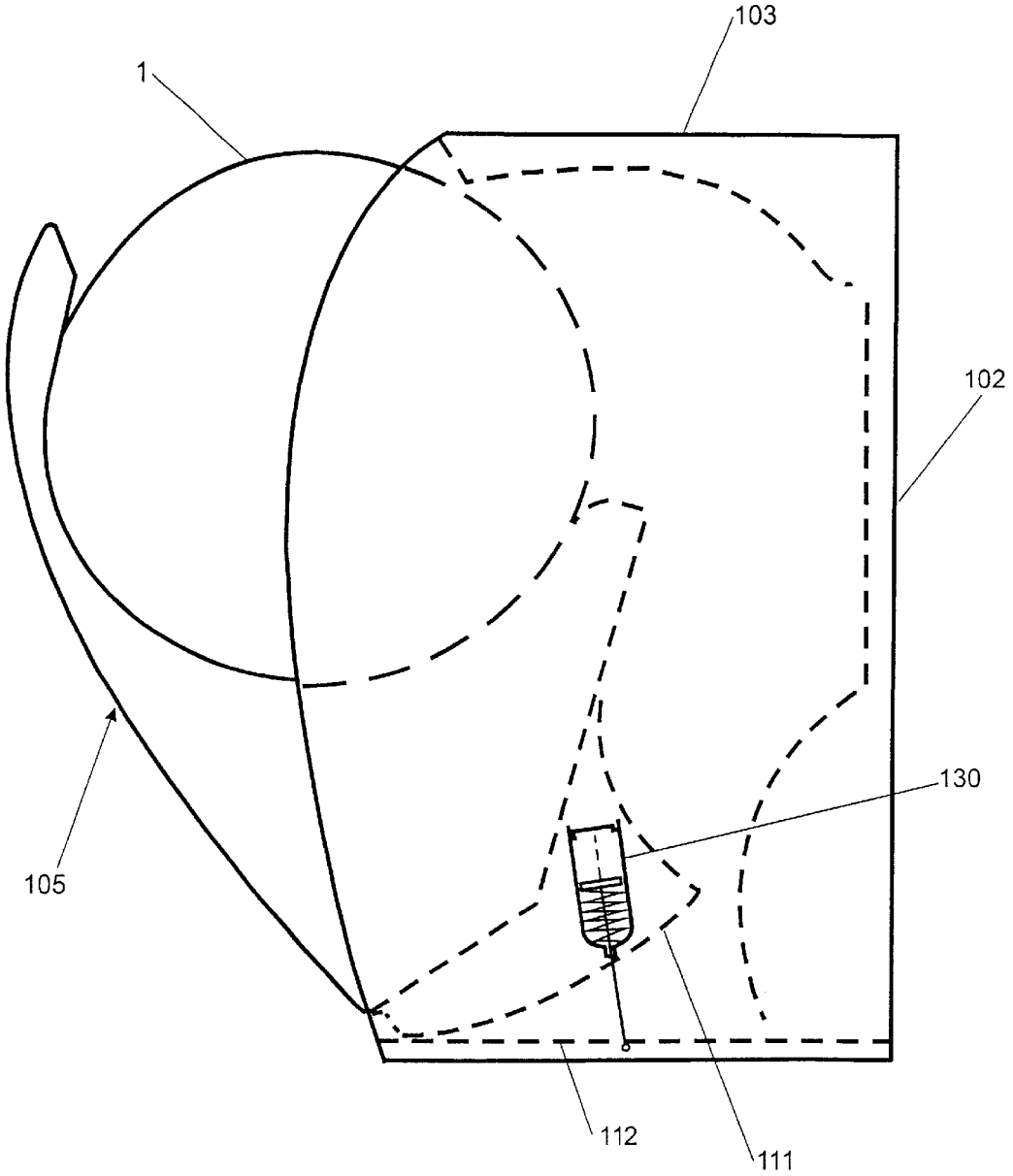
FIG. 4 shows diagrammatically a second form of rocking control for a washing machine of the present invention.

In a second embodiment shown in FIG. 4, instead of arranging the rocker geometry in relation to the centre of gravity of the sub-structure 105 to ensure the centre of gravity is vertically above the point of contact between rocker 111 and track 112 and thereby provide for easy opening and closing by a user, a spring damper 130 is pivotally coupled between the sub-structure and the washing cabinet 100. In this case the centre of gravity of the sub-structure can be displaced outwardly from the point of contact between rocker 111 and track 112 with the tilting force thus produced resisted by the spring damper 130 to allow comfortable handling by a user even when the drum 1 is carrying a wash load.

In a less preferred form each of the drum supports is formed to incorporate a pivot point on what may be considered the foot or the front corner thereof. The drum supports are joined to an inner door member which extends there between and itself incorporates the front section of the drum surround, to thereby form a unit which carries the drum and drive motor, and is pivotally connected to the base of the washer, at the bottom edge thereof. In use the user would pivot out the sub-structure in a manner akin to a tilt out drawer, to present the opened drum for loading or unloading of laundry.

The tiltable unit incorporates one or more liquid collection sumps at the lower end thereof, which collect runoff liquid from different areas of the surfaces enclosing the drum. With the arrangement shown there is no need for a fully sealed drum enclosure. The drum is in effect surrounded by a baffle including a rear wall portion 114, a top wall portion 115, and a front wall portion 116 carried by the tilt out unit with the front wall portion extending down and rearwardly to an edge 117 to underlap rib 117 of the back wall portion. One or more liquid collection sumps generally indicated as 108 (FIG. 1) are formed in the front wall portion adjacent the underlapping edge thereof. In use liquid exiting the drum through the perforations in the wall thereof drains down the front or rear wall portions and collects in the sump 108. The sump includes an outlet to which water within the sump drains. A pump is connected to the outlet, in the preferred embodiment being located directly below the outlet, to operate at the direction of the control processor.

In the preferred form of machine incorporating the present invention the wash liquid is passed directly into drum 1, through inlets disposed in one or both of the drum ends 11, 12. The shaft extending from each drum end, and over which the drum supporting bearing is fitted, preferably has a bore there through. Pressurised wash liquid is supplied to the drum interior through this bore.

Operation of the machine is controlled, as already alluded to, by a central microprocessor, which controls water valves, pumps and of the motor in accordance with programs residing within its memory, with user settings at a macro level and with signals from the out of balance, transducers and indications from the various motor loads, at a micro level. Physically the microprocessor is preferably located in an isolated and environment-proofed compartment mounted in the tiltable unit, between the front panel 106 and the inner front wall 151 of the tiltable structure 150. This places it in close proximity with nearly all of the items that it connects to. User settings are preferably made on a control pad, which is mounted on or adjacent the top edge of front panel 106 together with a corresponding display.

Figure 3C:
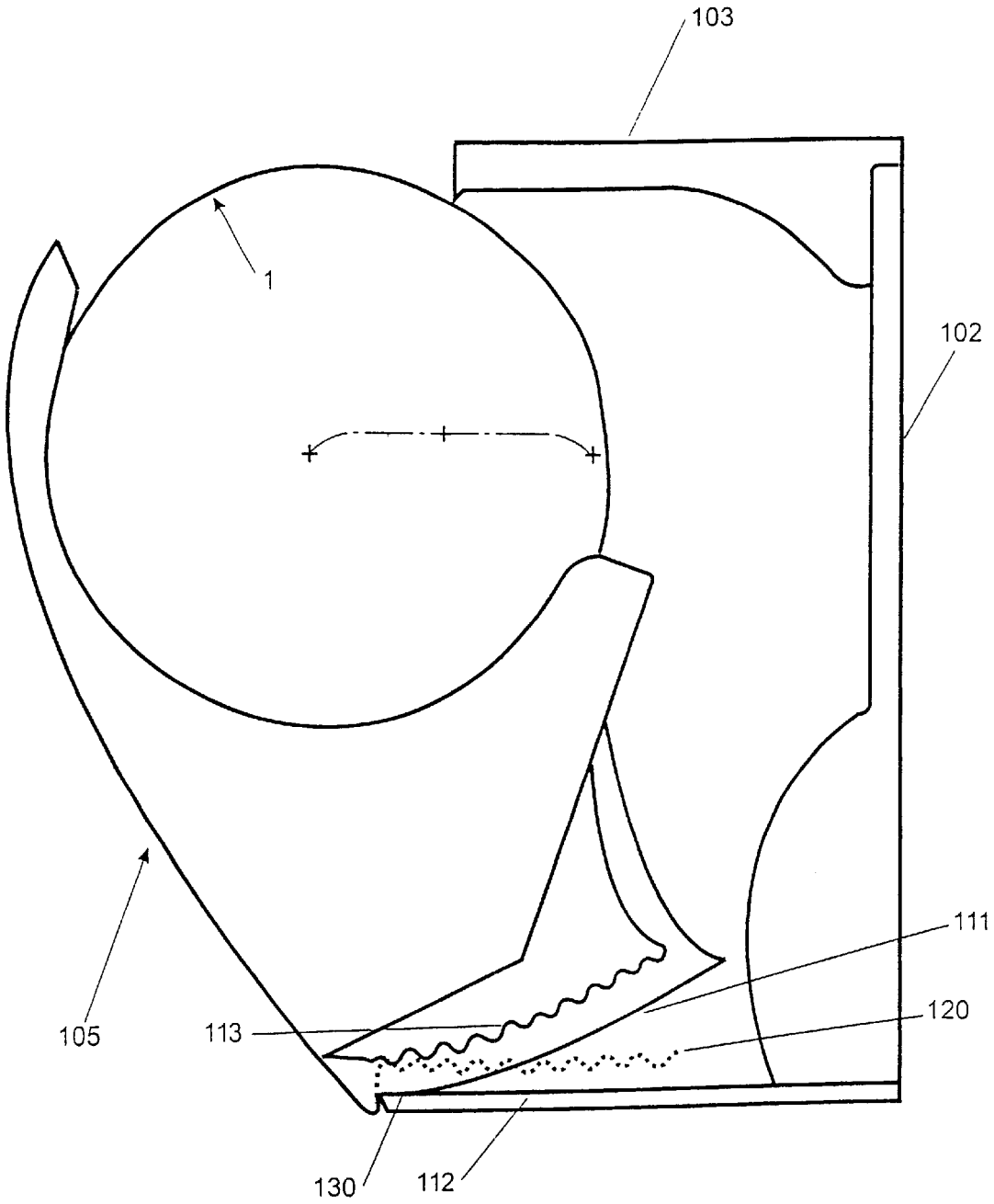

In use the washing operation begins with the delivery to the interior of the drum of a load of washing to be washed. Opening of the drum hatch is accomplished automatically prior to user access to the drum. In particular the machine includes a door latching means associated with the tiltable unit which restricts the ability to open the tiltable unit. Activation of the latch is intended to be accomplished by user activation of a touch control. It may however be by direct user actuation of the latch, in which case a sensor must detect when the latch is being operated. Preferably rotation of the drum 1 to a preferred opening position and opening of the drum hatch 35 is accomplished before the latch is fully released, so that on tilting out the tiltable unit 105 the contents of the drum are presented to the user. Therefore, as soon as delatching of the door is requested by the user, any operation currently in progress (for example spin or wash cycle) is terminated and drum 1 is brought substantially to rest at a position where the hatch section 35 may be opened. The sliding bar mechanism 40 of the hatch latch is drawn back to release the connection between edge 36 of the hatch section and corresponding edge 38 of the main drum section 34. With the hatch 35 retrained in that position drum 1 is then rotated clockwise in FIG. 1 to create the necessary opening, with the hatch section 35 lying about the outside of the main drum section 34 occurs. The drum is now in its open configuration (this is shown in FIG. 1) and delatching of the door to allow the user to open the door and access the interior of the drum as indicated in FIGS. 3*b* and 3*c*. The drum is locked in this position against rotation and remains in this condition until the door is closed and the wash cycle started or recommenced.

The user places a wash load in the drum and places whatever detergents and wash supplements are desired in appropriate depositories. The user then closes the door 106 and selects an appropriate wash program, for example by pressing the appropriate button on the control pad. A wash program may consist of any combination of soak, wash, rinse and spin cycles of varying intensity and duration. For the sake of convenience the following description of machine operation will be based on a simple single wash, single spin, single rinse, single spin program.

With the wash load in the drum and the door closed, the process of opening the drum is reversed. The main drum section 34 is rotated (anti-clockwise in FIG. 1) to draw the hatch section back across the drum opening until the trailing edge 36 of the hatch section is hooked and retained by the hooked over portions of the edge 38 of the drum opening and the leading edge 37 of the hatch section meets with edge 39 of drum section 34. The sliding bolt 40 is returned to the retained position to securely interconnect edges 36 and 38, and the hatch section is released. At this point the wash, rinse and spin cycles can begin. These will not be described as any number of known regimes of water transfer and drum action may be used.

A clothes drier employing the tilt out configuration of the present invention is shown in FIG. 5. A tiltable sub-structure 205 carrying a drier drum 201 is supported by a rocker ratchet 213 which travels on track 220. The sub-structure 205, as with the corresponding washer sub-structure 105 is retained within a cabinet 200 of which rear wall 202 and top 203 are shown. The drum 201 is rotated by a motor 210.

Figure 6:
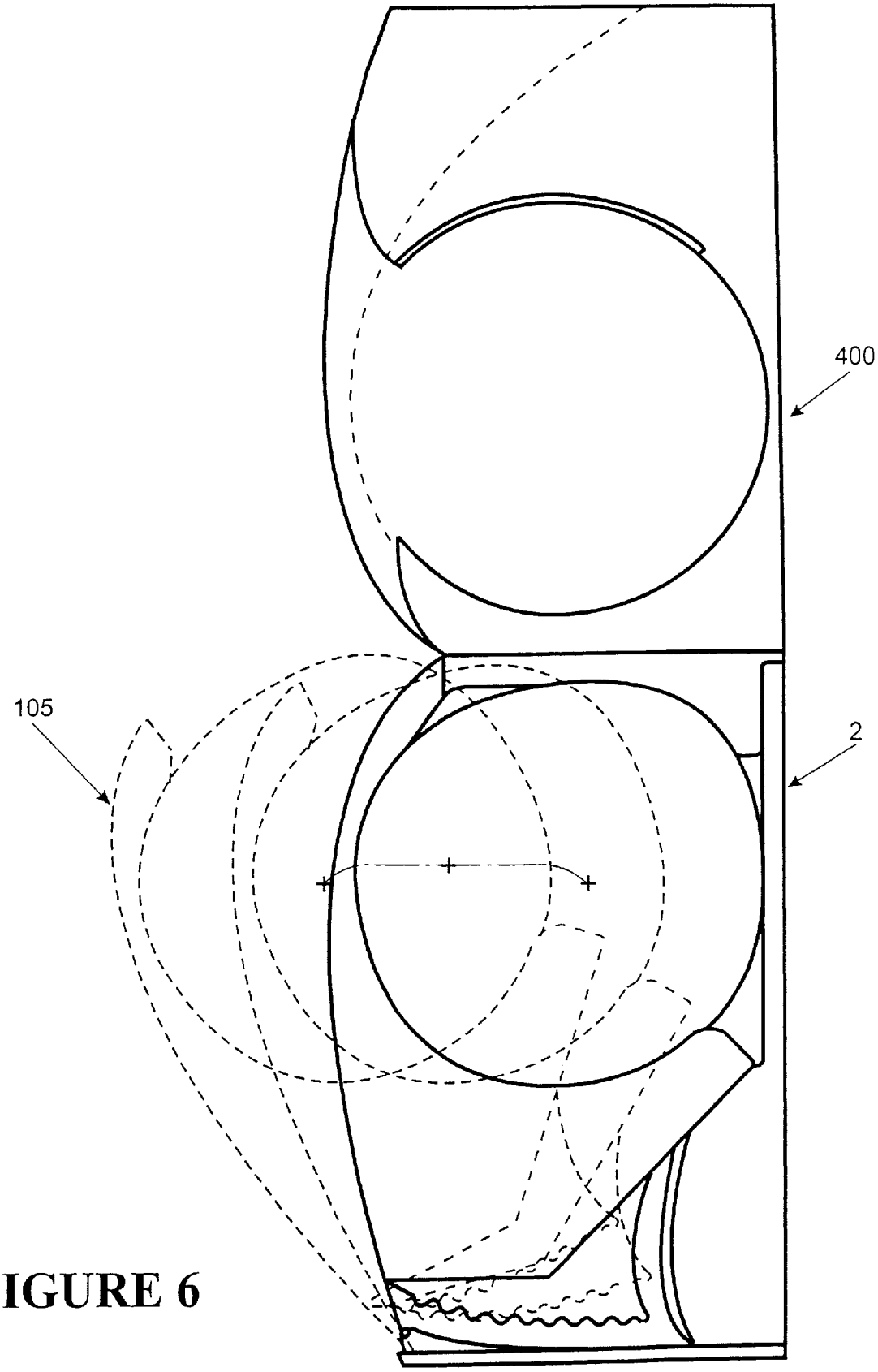
FIG. 6 shows a clothes drier of the present invention stacked on top of a washing machine of the present invention.

An incidental benefit of a top loading horizontal axis washer of the type disclosed herein is that other appliances, and in particular a clothes drier 400, may be stacked on top to conserve floor space in a laundry as shown in FIG. 6.

Figure 7:
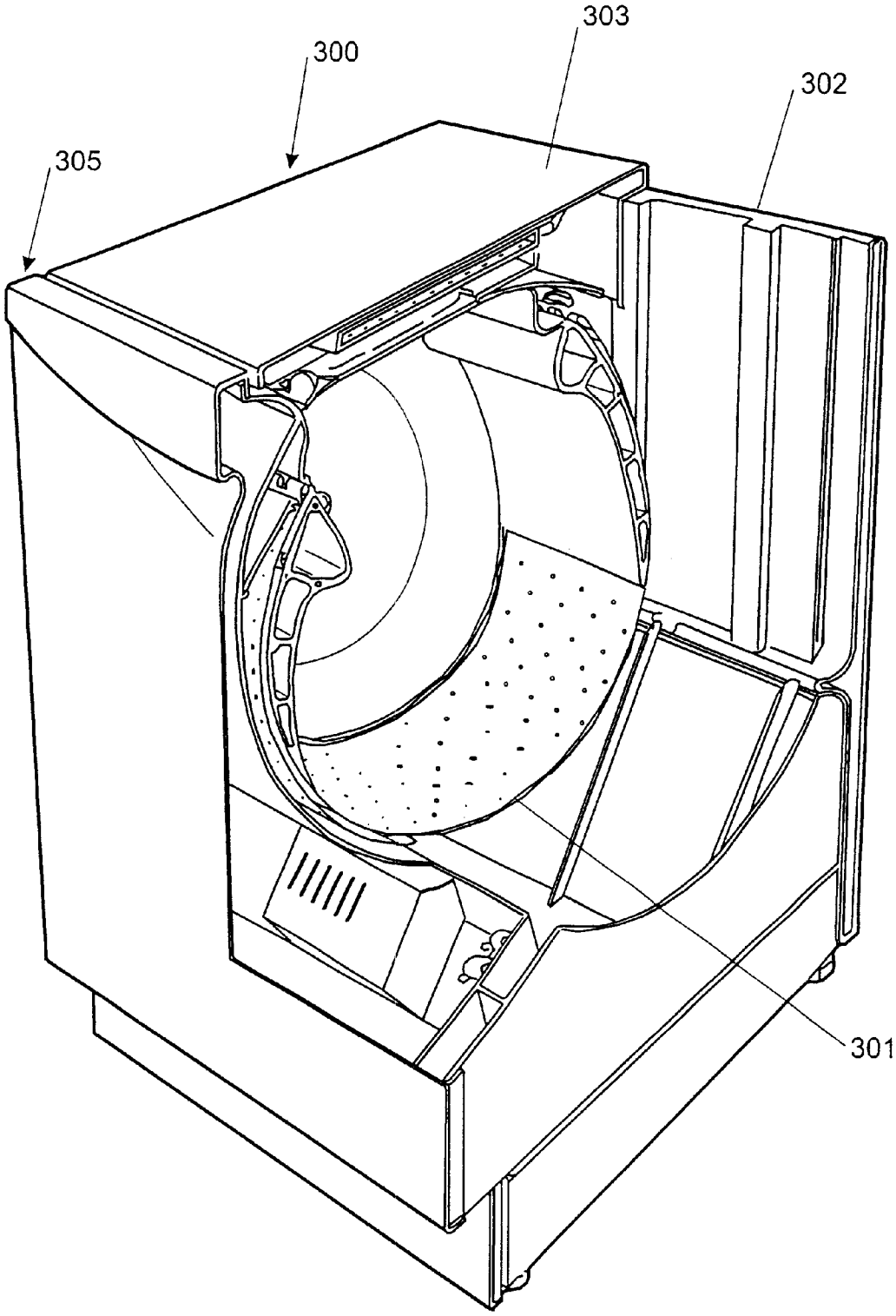
FIG. 7 shows a further embodiment of a washing machine using a sliding drawer mechanism in place of a tilting/rocking mechanism.

As an alternative to the tilting/rocking mechanism described, ergonomic presentation of the clothes drum may be achieved using a "sliding drawer" configuration. Such a configuration is shown applied to a washing machine in FIG. 7. A sub-structure 305 supports drum 301 and moves linearly and horizontally in and out of washer cabinet 300. The sub-structure may be supported on tracks affixed thereto which ride on rollers which in turn are supported on horizontal tracks which telescope out of cabinet 300 on opening. When open the drum surface is exposed to the user from the top and the drum rotation is controlled to present an open hatch to allow top loading or unloading of the clothes drum.

What is claimed is:

1. A laundry appliance comprising:

(a) a cabinet, (b) a laundry handling system moveably mounted within said cabinet in such a manner that it may be withdrawn out of said cabinet for access thereto, said laundry handling system including:

(i) a structure moveably coupled within the interior of said cabinet in such a way as to allow at least the upper part of the structure to be moved outwardly from said cabinet, (ii) a vessel for accommodating said laundry rotatably supported within said structure such that the rotational axis of said vessel is horizontal, (iii) means for rotating said vessel, (iv) means for introducing fluid into said vessel, (v) means for evacuating fluid from said vessel, and (c) a front panel which forms part of said structure and which when the laundry handling system is retracted closes said cabinet to provide a fluid tight envelope about said vessel.

2. A laundry appliance according to claim 1 wherein said structure is moveably coupled at lower side portions thereof to the interior of said cabinet to allow the structure to revolve about said lower side portions to thereby permit said laundry handling system to be forwardly tilted to project out from said cabinet for access thereto.

3. A laundry appliance according to claim 1 wherein said structure is provided with rocking surfaces which engage with forward to back tracks provided in the base of said cabinet to form a rolling contact therewith.

4. A laundry appliance according to claim 1 wherein said structure is provided at the bottom with transversely spaced apart convex rocking projections which support the weight of said laundry handling system, said cabinet is provided with transversely spaced apart tracks in the base thereof upon which said rocking projections engage to form a rolling contact therewith.

5. A laundry appliance according to claim 1 wherein said structure is pivoted within said cabinet at the base thereof to allow the laundry handling system to be rotated forwardly out of said cabinet.

6. A laundry appliance according to claim 1 wherein said laundry handling system is slidably mounted within said cabinet in such a manner that it may be withdrawn horizontally out of said cabinet for access thereto.

7. A laundry appliance comprising:

(a) a cabinet containing transversely spaced apart forward to back tracks interiorly mounted in the base thereof, (b) a laundry handling system mounted in said cabinet so as to be forwardly tilted from the top to project out of said cabinet for access thereto, said laundry handling system including:

(i) a structure which is movably mounted within said cabinet, said structure being supported on two transversely spaced apart forward to back curved rocking surfaces which engage with said cabinet tracks to form a rolling contact therewith, (ii) a vessel which in use contains said laundry rotatably supported within said structure, (iii) means for rotating said vessel, (iv) means for introducing fluid into said vessel, (v) means for evacuating fluid from said vessel, (c) a front panel which forms part of said structure and which when the laundry handling system is retracted closes said cabinet to provide a fluid tight envelope about said vessel.

8. A laundry appliance according to claim 7 wherein said structure is so configured and said vessel is located in said structure such that the center of gravity of said laundry handling system lies substantially in a vertical plane which passes through the points of contact between said rocking surfaces and said cabinet tracks while the laundry handling system revolves between the retracted position and the tilted positions.

9. A laundry appliance according to claim 7 wherein said lower side portions of said structure are provided with a curved rack formation which is parallel to but vertically spaced apart from said rocking surfaces and corresponding rack formations are provided in the bottom sides of said cabinet, said rack formations each engaging with a respective cabinet rack to thereby ensure that the line of rolling contact defined by the contact points of each rocking surface and cabinet track remains orthogonal to the cabinet sides during tilting of the laundry handling system.

* * * * *